US005336966A

United States Patent [19]

Nakatsugawa et al.

[11] Patent Number: 5,336,966

[45] Date of Patent: Aug. 9, 1994

[54] 4-LAYER STRUCTURE REFLECTION TYPE PHOTOCATHODE AND PHOTOMULTIPLIER USING THE SAME

[75] Inventors: Kiyoshi Nakatsugawa; Kazuyoshi Oguri; Hiroyuki Onda; Hiroyuki Watanabe, all of Hamamatsu, Japan

[73] Assignee: Hamamatsu Photonics K.K., Shizuoka, Japan

[21] Appl. No.: 943,524

[22] Filed: Sep. 11, 1992

[30] Foreign Application Priority Data

Sep. 11, 1991 [JP] Japan ..... 3-231938

[51] Int. Cl.[5] ..... H01J 1/34; H01J 43/08

[52] U.S. Cl. ..... 313/532; 313/542; 313/530; 250/214.1; 250/207

[58] Field of Search ..... 313/532, 533, 542, 541, 313/544, 530, 523; 250/214, 207

[56] References Cited

U.S. PATENT DOCUMENTS 2,585,534 2/1952 Bull et al. .
2,676,282 4/1954 Polkosky .
4,039,887 8/1977 McDonie et al. ..... 313/532
4,160,185 7/1979 Tomasetti et al. .
4,419,603 12/1983 Nussli et al. ..... 313/532
4,446,401 5/1984 Faulkner et al. ..... 313/533
4,604,545 8/1986 McDonie et al. ..... 313/533
4,912,315 3/1990 Arakawa et al. ..... 313/532

FOREIGN PATENT DOCUMENTS 1169213 12/1958 France ..... 313/533
1345063 11/1963 France .
4292843 10/1992 Japan ..... 313/532

*Primary Examiner*—Donald J. Yusko
*Assistant Examiner*—N. D. Patel
*Attorney, Agent, or Firm*—Sughrue, Mion, Zinn, Macpeak & Seas

[57] ABSTRACT

A high performance reflection type photocathode for use in a photomultiplier tube is formed by sequentially depositing three layers on a substrate made of nickel. The first layer is made of either one of chromium, manganese and magnesium as a major component and is deposited over the substrate. The second layer is made of aluminum as a major component and is deposited over the first layer. The third layer is made of antimony and at least one kind of alkaline metals and is deposited over the second layer.

12 Claims, 4 Drawing Sheets

4-LAYER STRUCTURE REFLECTION TYPE PHOTOCATHODE AND PHOTOMULTIPLIER USING THE SAME

BACKGROUND OF THE INVENTION

1. Field of the Invention

The present invention relates to a reflection type photocathode and a photomultipler using the same.

2. Description of the Prior Art

The photomultiplier is a very versatile and sensitive detector of radiant energy in the ultraviolet, visible, and near infrared regions of the electromagnetic spectrum. In the photomultiplier, the basic radiation sensor is the photocathode which is located inside a vacuum envelope. Photoelectrons are emitted and directed by an appropriate electric field to an electrode or dynode within the envelope. A number of secondary electrons are emitted at the dynode for each impinging primary photoelectron. These secondary electrons in turn are directed to a second dynode and so on until a satisfactory gain is achieved. The electrons from the last dynode are collected by an anode which provides the signal current that is read out.

One type of the photomultipliers uses a reflection type photocathode and another type thereof uses a transmission type photocathode. The reflection type photocathode is typically made up of a nickel substrate, an aluminum layer deposited over the substrate, a layer of antimony and alkaline metal such as cesium (Cs), natrium (Na) deposited over the aluminum layer.

Various properties of the reflection type photocathode changes considerably depending on how the layer structure is determined or what kind of materials is used for each layer.

SUMMARY OF THE INVENTION

In view of the foregoing, the present inventors explored the properties of numerous photocathode materials and provide a higher sensitive reflection type photocathode.

According to the present invention, there is provided a reflection type photocathode for use in a photomultiplier tube, which comprises a substrate, a first layer deposited over the substrate, a second layer deposited over the first layer and a third layer deposited over the second layer. The first layer is made of a material selected from a group consisting of chromium, manganese and magnesium as a major component. The second layer is made of aluminum as a major component. The third layer is made of antimony and at least one kind of alkaline metal.

It is preferred that the first layer have a thickness in a range of from 20 to 500 angstrom and the thickness of the third layer is obtained by depositing; 5 to 15 $\mu g/cm^2$ of the material forming the third layer.

In another aspect of the present invention, there is provided a photomultiplier using the photocathode described above.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENTS

Figure 1:
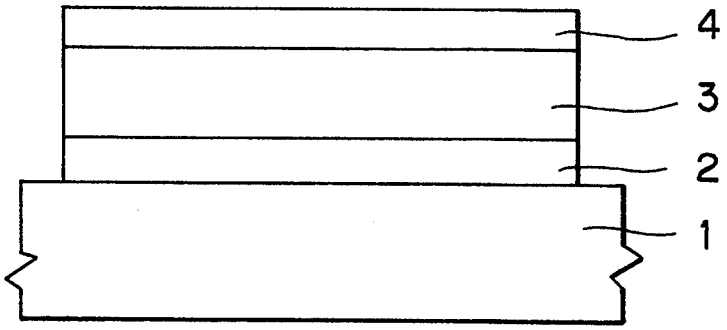
FIG. 1 is a cross-sectional view showing a reflection type photocathode made according to the present invention.

Referring to FIG. 1, there is shown a reflection type photocathode according to a preferred embodiment of the present invention. As shown, the photocathode is made up of a substrate 1 serving as an electrode, a first layer 2 deposited over the substrate 1, a second layer 3 deposited over the first layer 2, and a third layer 4 deposited over the second layer 3. The electrode or substrate 1 is made of nickel. The electrode 1 may not necessarily be a pure nickel plate but it may be a plate-like member with a nickel plating on the surface thereof. Alternatively, the electrode 1 may be a plate-like member containing nickel such as a stainless plate.

The first layer 2 is made of either one of chromium, manganese and magnesium. It is desirable that the first layer 2 be uniform in thickness ranging from 20 to 500 angstrom (Å). The second layer 3 is made of aluminum. The thickness of the aluminum layer 3 remain essentially the same as that of the conventional aluminum layer, say 2000 angstrom. No problem arises even if the aluminum layer 3 is oxidized and no matter what degree the aluminum layer 3 is oxidized during the manufacturing process. The third layer 4 is made of antimony and at least one kind of alkaline metal so as to be sensitive to electromagnetic spectrum radiation. In the experiment, the thickness of the third layer is obtained by depositing 5 to 15 $\mu g/cm^2$ of antimony onto the second layer. Examples of the alkaline metals are cesium, rubidium (Rb), natrium, kalium (K). Two or more such alkaline metals may be contained in the third layer or radiation sensitive layer 4 so as to provide bialkali or multialkali structure.

Manufacturing process of the reflection type photocathode will next be described. Firstly, the chromium layer 2 and the aluminum layer 3 are sequentially deposited on the nickel substrate 1 by way of vacuum evaporation or sputtering until the thickness of each layer comes to a preselected value. Thereafter, air or gaseous matters contained in the envelope of the photomultiplier is sucked out while heating the envelope for about 45 minutes at a temperature of 260° C., whereupon antimony, natrium and kalium are supplied into the envelope and are rendered active for the formation of the radiation sensitive layer 3 over the aluminum layer 3. The formation method of the layer 4 is essentially the same as has been practiced conventionally and is well known in the art. Therefore, further description thereof is omitted herein.

Figure 2:
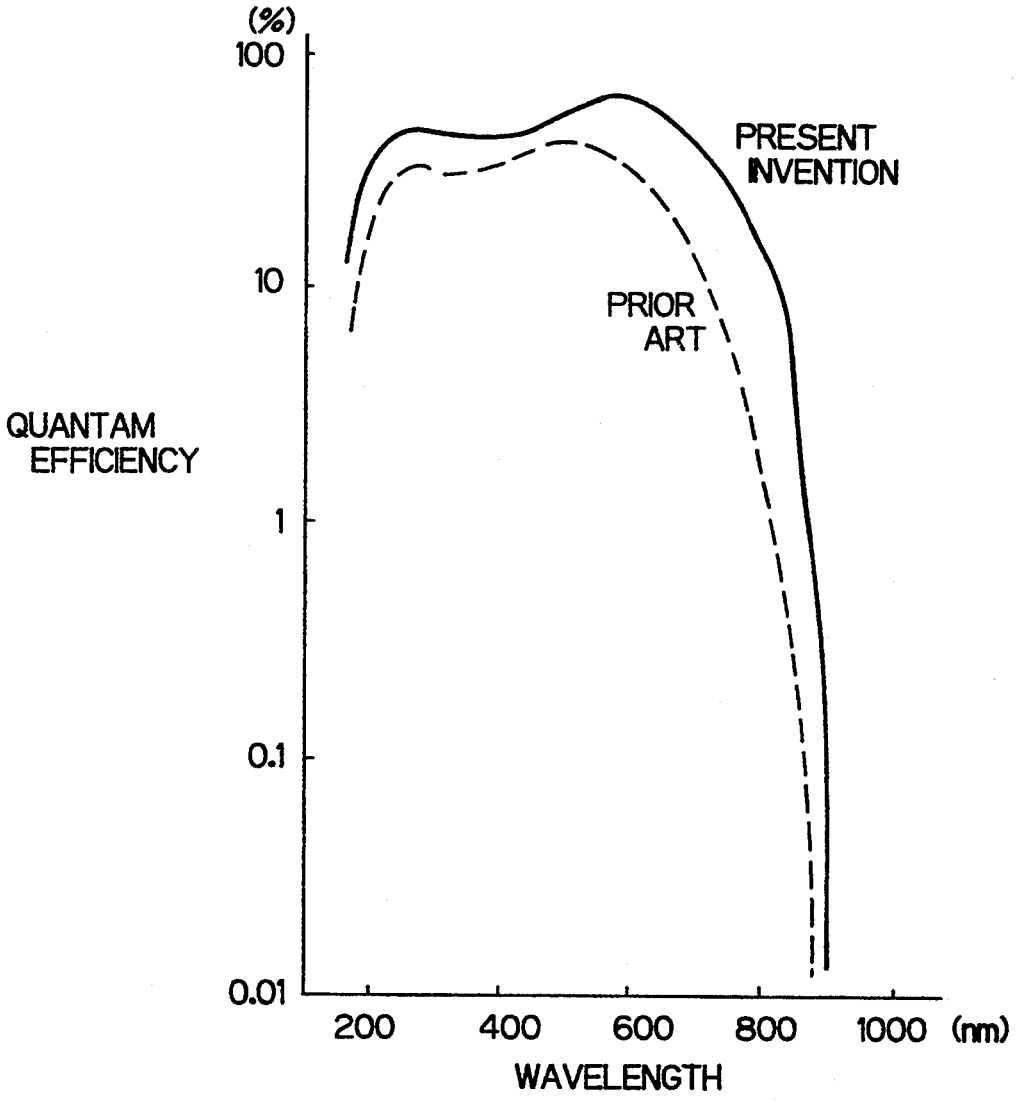
FIG. 2 is a graphical representation showing quantum efficiency characteristics of a prior art and inventive photocathode.

FIG. 2 shows quantum efficiency characteristics of a conventional photocathode and an improved photocathode manufactured in accordance with the present invention. The quantum efficiency refers to an average number of electrons photoelectrically emitted from a photocathode per incident photon of a given wavelength. Both the conventional and inventive photocathodes subject to measurement use pure nickel plate for the substrate 1, a 2000 angstrom thick aluminum layer 3, and antimony, cesium, natrium and kalium for the radiation sensitive layer 4. In the inventive photocathode, a 100 angstrom thick chromium layer 2 is interposed between the nickel substrate 1 and the aluminum layer 3. As can be appreciated from FIG. 2, the inventive photocathode exhibits excellent quantum efficiency over the entire wavelength range, particularly in the wavelength ranging from 600 to 900 nanometers.

Figure 3:
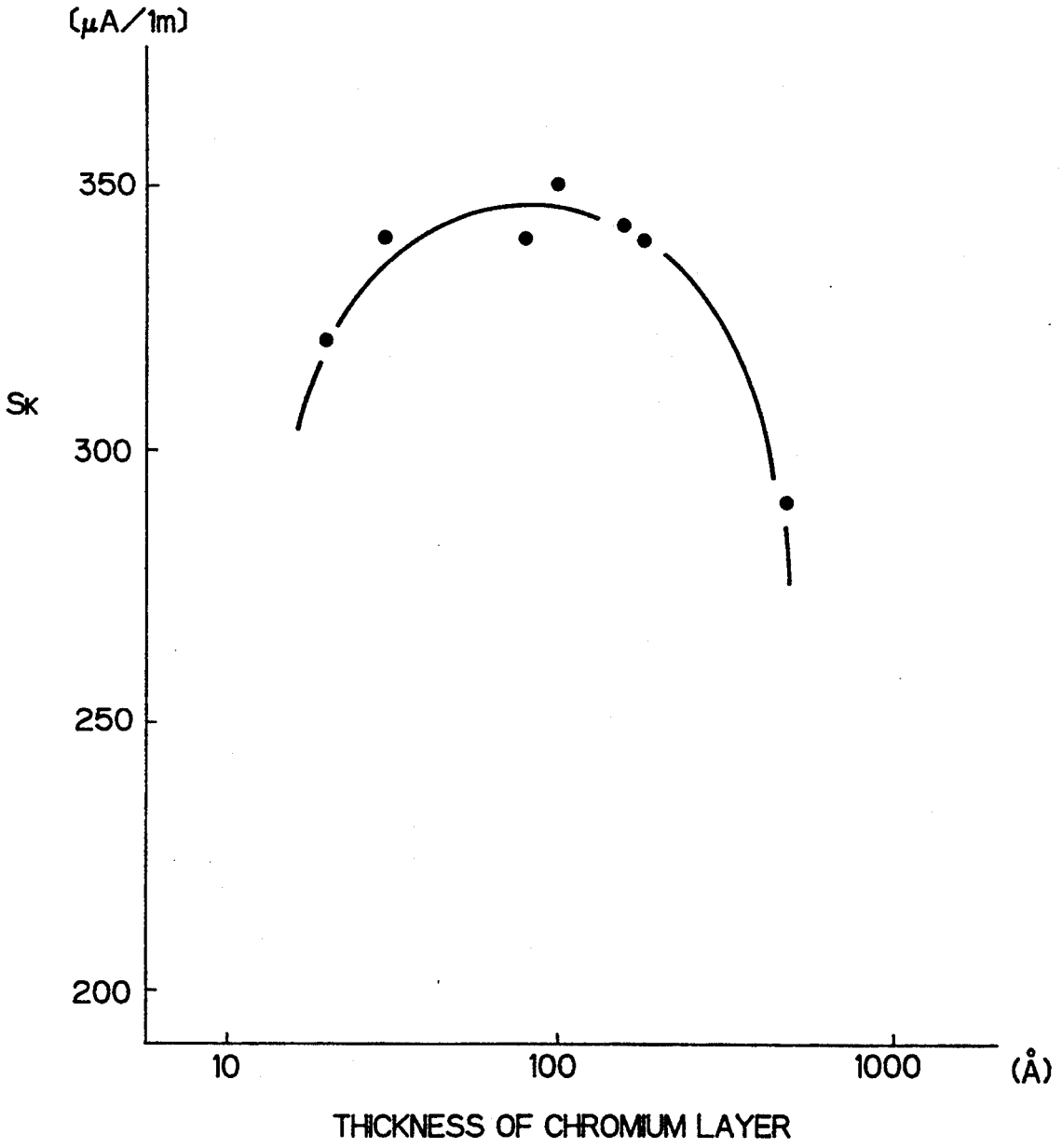
FIG. 3 is a graphical representation showing dependency of Sk value on the thickness of a chromium layer.

FIG. 3 shows dependency of Sk value (photocathode's lumen sensitivity) on the thickness of chromium layer 2, where the Sk values plotted on the graph in relation to the thickness of the chromium layer 2 represent average Sk values of the number of photocathodes test conducted for the same chromium thickness. The number of the test conducted photocathodes are as follows:

Five for 20 angstrom thickness chromium layer;
Five for 30 angstrom thickness chromium layer;
Thirty for 90 angstrom thickness chromium layer;
Forty for 100 angstrom thickness chromium layer;
Forty for 110 angstrom thickness chromium layer;
Twenty five for 180 angstrom thickness chromium layer; and
Five for 500 angstrom thickness chromium layer.

While the above embodiment uses chromium for the first layer 2, manganese or magnesium may be used therefor instead of chromium.

Figure 4A:
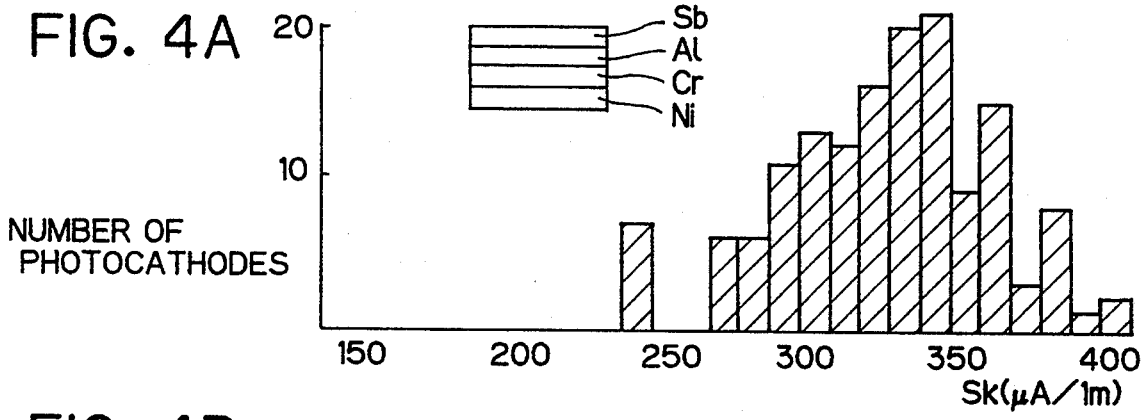
FIGS. 4A through 4C show occurrence frequencies of Sk values of the photomultipliers manufactured according to the present invention and FIG. 4D shows an occurrence frequency of Sk value of the prior art photomultipler.
Figure 4B:
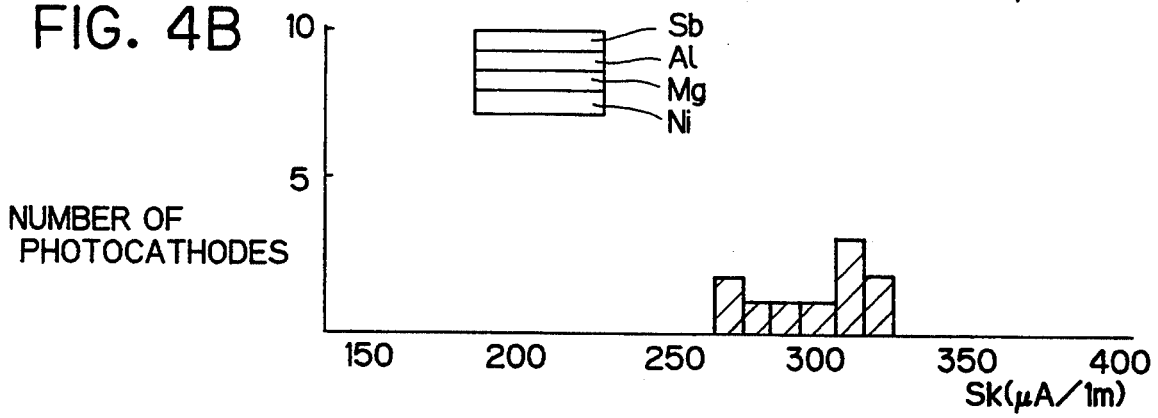
Figure 4C:
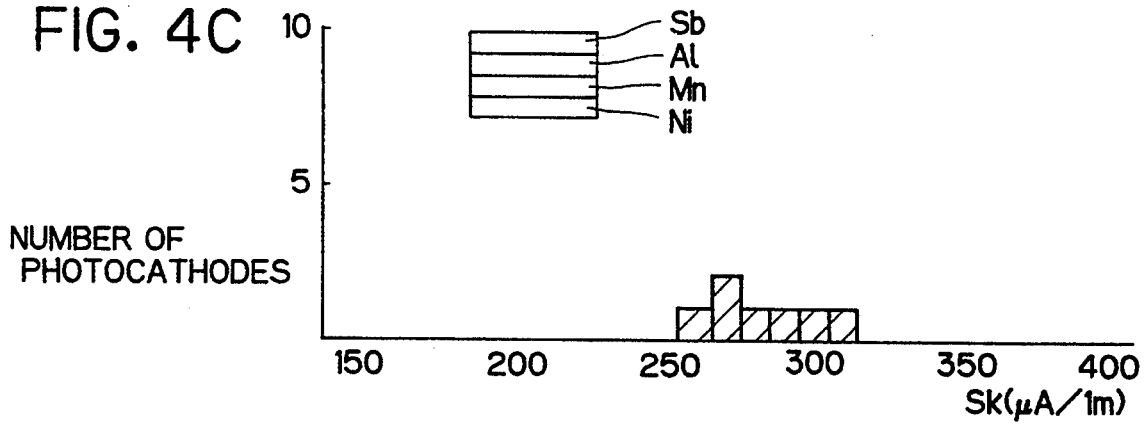
Figure 4D:
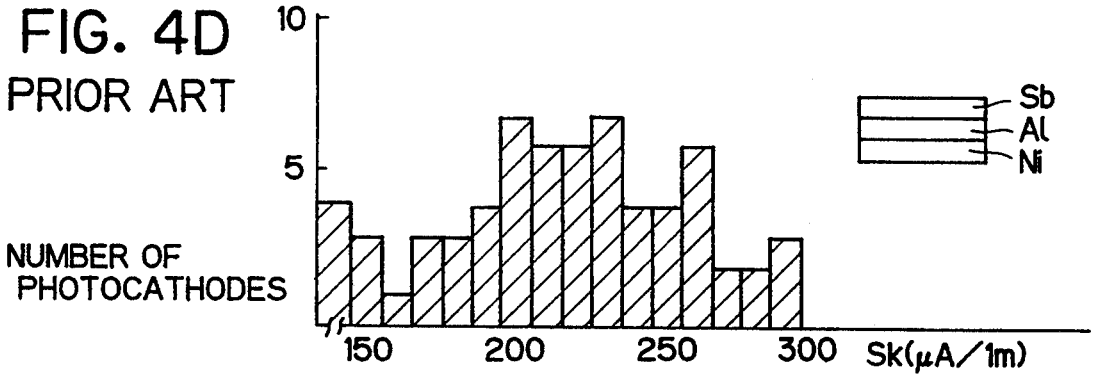
FIG. 4D PRIOR ART

FIGS. 4A through 4D shows occurrence frequency, i.e., number of photomultipliers, of the Sk value, where FIG. 4A is of the case using chromium for the first layer 2 according to the present invention, FIG. 4B is of the case using magnesium for the first layer 2 according to the present invention, FIG. 4C is of the case using manganese for the first layer 1 according to the present invention, and FIG. 4D is of the case using the conventional structure in which the chromium, magnesium or manganese layer is not provided unlike the present invention. According to the inventive layer structure, it can be appreciated that the reflection type photocathodes with high Sk value can be produced with excellent yieldablity.

Figure 5:
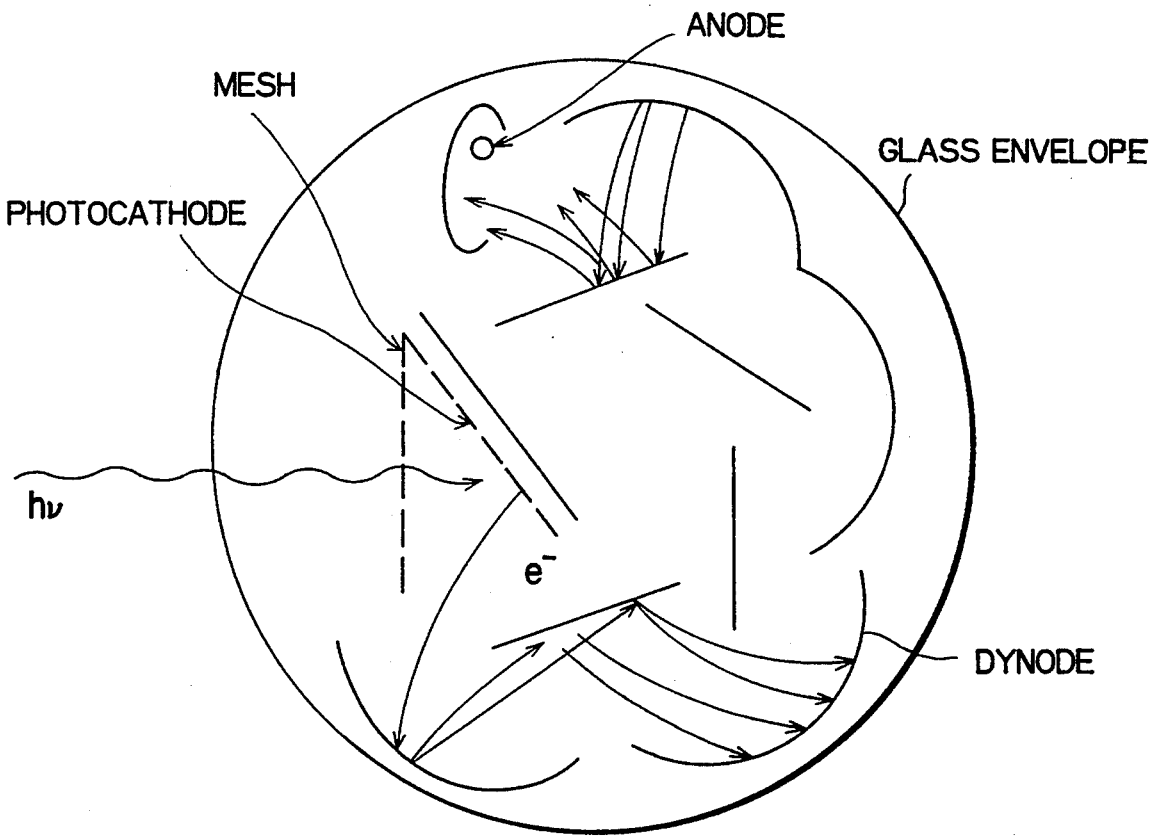
FIG. 5 is a cross-sectional view showing an arrangement of a photomultiplier tube according to the present invention.

The reflection type photocathode of the invention can be applied to, for example, a circular-cago structure photomultiplier with end-on photocathode as shown in FIG. 5. In the illustrated photomultiplier, when light is incident on the photocathode through a glass envelope, photoelectrons are emitted from the photocathode and are directed to a first dynode. A number of secondary electrons are emitted at the first dynode for each impinging primary photoelectron. These secondary electrons in turn are directed to a second dynode and so on. The electrons from the last dynode are collected by an anode which provides the signal current that is read out.

As described, with the use of the reflection type photocathode constructed in accordance with the present invention, the quantum efficiency is greatly improved and in addition, high Sk values can be effectively realized. Further, a large number of applications in the field of dark light measurement can be accomplished with the use of the photocathode of the present invention. Yet further, detection of extremely weak light which cannot be readily achieved with the prior art devices can be readily done with the photomultiplier constructed in accordance with the present invention.

What is claimed is:

1. A reflection type photocathode for use in a photomultiplier tube, comprising:
a substrate
a first layer containing chromium as a major component and being deposited over said substrate;
a second layer containing aluminum as a major component and being deposited over said first layer; and
a third layer containing antimony and at least one kind of alkaline metal and being deposited over said second layer.

2. The photocathode according to claim 1, wherein said first layer has a thickness in a range of from 20 to 500 angstrom.

3. The photocathode according to claim 1, wherein said third layer has a thickness obtained by depositing 5 to 15 $\mu g/cm^2$ of a material containing said antimony and said at least one kind of alkaline metal over said second layer.

4. A reflection type photocathode for use in a photomultiplier tube, comprising:
a substrate;
a first layer containing manganese as a major component and being deposited over said substrate;
a second layer containing aluminum as a major component and being deposited over said first layer; and
a third layer containing antimony and at least one kind of alkaline metal and being deposited over said second layer.

5. The photocathode according to claim 4, wherein said first layer has a thickness in a range of from 20 to 500 angstrom.

6. The photocathode according to claim 4, wherein said third layer has a thickness obtained by depositing 5 to 15 $\mu g/cm^2$ of a material containing said antimony and said at least one kind of alkaline metal over said second layer.

7. A reflection type photocathode for use in a photomultiplier tube, comprising:
a substrate;
a first layer containing magnesium as a major component and being deposited over said substrate;
a second layer containing aluminum as a major component and being deposited over said first layer; and
a third layer containing antimony and at least one kind of alkaline metal and being deposited over said second layer.

8. The photocathode according to claim 7, wherein said first layer has a thickness in a range of from 20 to 500 angstrom.

9. The photocathode according to claim 7, wherein said third layer has a thickness obtained by depositing 5 to 15 $\mu g/cm^2$ of material containing said antimony and said at least one kind of alkaline metal over said second layer.

10. A photomultiplier comprising:
a glass envelope;
a photocathode disposed within said glass envelope, said photocathode comprising a substrate, a first layer containing one selected from the group consisting of chromium, manganese and magnesium as a major component and being deposited over said substrate, a second layer containing aluminum as a major component and being deposited over said first layer, and a third layer containing antimony and at least one kind of alkaline metal and being deposited over said second layer;

at least one dynode disposed within said glass envelope to receive photoelectrons produced from said photocathode; and anode disposed within said glass envelope to correct secondary electrons emitted from said dynode, a signal current being derived from said anode.

11. The photomultiplier according to claim 10, wherein said first layer of said photocathode has a thickness in a range of from 20 to 500 angstrom.

12. The photocathode according to claim 10, wherein said third layer of said photocathode has a thickness obtained by depositing 5 to 15 $\mu g/cm^2$ of material containing said antimony and said at least one kind of alkaline metal over said second layer.

* * * * *